US009487736B2

(12) United States Patent
Gallez et al.

(10) Patent No.: US 9,487,736 B2
(45) Date of Patent: Nov. 8, 2016

(54) GRANULATED FOAM CONTROL AGENT FOR THE RINSE CYCLE USING SILOXANE WAX

(75) Inventors: Laurence Gallez, Jurbise (BE); Corina Pagnoni, La Louviere (BE); Christel Simon, Lobbes (BE); Nicolas Ziolkowski, Nivelles (BE)

(73) Assignee: Dow Corning Corporation, Midland, MI (US)

( * ) Notice: Subject to any disclaimer, the term of this patent is extended or adjusted under 35 U.S.C. 154(b) by 0 days.

(21) Appl. No.: 14/378,278

(22) PCT Filed: Aug. 15, 2012

(86) PCT No.: PCT/US2012/050977

§ 371 (c)(1),
(2), (4) Date: Aug. 12, 2014

(87) PCT Pub. No.: WO2013/122619

PCT Pub. Date: Aug. 22, 2013

(65) Prior Publication Data

US 2015/0038388 A1 Feb. 5, 2015

(30) Foreign Application Priority Data

Feb. 16, 2012 (WO) ..... PCT/US2012/025474

(51) Int. Cl.

| | |
|---|---|
| ***C11D 9/36*** | (2006.01) |
| ***C11D 1/82*** | (2006.01) |
| ***C11D 3/08*** | (2006.01) |
| ***C11D 7/14*** | (2006.01) |
| ***C11D 3/00*** | (2006.01) |
| ***C11D 3/12*** | (2006.01) |
| ***C11D 3/37*** | (2006.01) |
| ***C11D 11/00*** | (2006.01) |

(52) U.S. Cl.

CPC ..... *C11D 3/0026* (2013.01); *C11D 3/1246* (2013.01); *C11D 3/373* (2013.01); *C11D 3/3749* (2013.01); *C11D 11/0088* (2013.01)

(58) Field of Classification Search

CPC ..... C11D 1/82; C11D 3/0026; C11D 3/08; C11D 3/124; C11D 3/162; C11D 3/373; C11D 3/3742; C11D 7/14; C11D 9/225; C11D 9/36; C11D 11/0017

See application file for complete search history.

(56) References Cited

U.S. PATENT DOCUMENTS

| | | | | |
|---|---|---|---|---|
| 3,959,175 | A | 5/1976 | Smith, Jr. et al. | |
| 4,894,177 | A * | 1/1990 | Starch | 510/444 |
| 4,978,471 | A | 12/1990 | Starch | |
| 5,045,225 | A * | 9/1991 | Aronson | B01D 19/0409 510/303 |
| 5,229,033 | A | 7/1993 | Nguyen et al. | |
| 5,562,862 | A | 10/1996 | Berzansky, Jr. et al. | |
| 5,681,808 | A | 10/1997 | Kobayashi et al. | |
| 5,777,059 | A | 7/1998 | Datz-Siegel et al. | |
| 6,124,490 | A | 9/2000 | Gormley et al. | |
| 6,165,968 | A * | 12/2000 | Lenoble | 510/466 |
| 6,180,712 | B1 | 1/2001 | Ishikawa et al. | |
| 6,404,064 | B1 | 6/2002 | Tsai et al. | |
| 6,512,015 | B1 | 1/2003 | Elms et al. | |
| 6,521,586 | B1 | 2/2003 | Hoogland et al. | |
| 6,521,587 | B1 | 2/2003 | L'Hostis et al. | |
| 6,656,975 | B1 | 12/2003 | Christiano et al. | |
| 7,407,991 | B2 * | 8/2008 | Creutz et al. | 516/120 |
| 7,550,514 | B2 | 6/2009 | Rautschek et al. | |
| 7,619,043 | B2 | 11/2009 | Rautschek et al. | |
| 7,632,890 | B2 | 12/2009 | Creutz et al. | |
| 8,084,566 | B2 | 12/2011 | Rautschek et al. | |
| 8,138,294 | B2 | 3/2012 | Henning et al. | |
| 8,222,303 | B2 | 7/2012 | Herzig et al. | |
| 8,536,109 | B2 | 9/2013 | Delbrassinne et al. | |
| 8,633,147 | B2 | 1/2014 | Paul et al. | |
| 8,653,214 | B2 | 2/2014 | Venzmer et al. | |
| 8,673,985 | B2 | 3/2014 | Lange et al. | |
| 8,785,587 | B2 | 7/2014 | Wagner et al. | |
| 9,175,141 | B2 | 11/2015 | Wray et al. | |
| 2001/0009896 | A1 | 7/2001 | Hoogland et al. | |
| 2003/0056301 | A1 | 3/2003 | Dekker et al. | |
| 2007/0161539 | A1 | 7/2007 | Hernandez | |
| 2007/0167346 | A1 * | 7/2007 | Creutz et al. | 510/511 |
| 2008/0021152 | A1 | 1/2008 | Rautschek et al. | |
| 2008/0021182 | A1 | 1/2008 | Jones | |
| 2008/0293606 | A1 | 11/2008 | Rautschek et al. | |

(Continued)

FOREIGN PATENT DOCUMENTS

| | | |
|---|---|---|
| DE | 102006044839 | 4/2008 |
| EP | 0210731 | 2/1987 |

(Continued)

OTHER PUBLICATIONS

International Preliminary Report on Patentability, PCT/US2012/050977, dated Aug. 19, 2014, 1 page.

(Continued)

*Primary Examiner* — Charles Boyer

(74) *Attorney, Agent, or Firm* — Warner Norcross & Judd LLP

(57) ABSTRACT

A granulated antifoam composition comprising an antifoam, a siloxane wax binder, and a carrier. The antifoam includes a hydrophobic fluid wherein the hydrophobic fluid has a surface tension which is greater than or approximately equal to the dynamic surface tension of an aqueous dispersion of the detergent at above the critical micelle concentration of the surfactant and less than about 62 mN/m. The antifoam further includes a finely divided solid hydrophobic filler dispersed in the hydrophobic fluid.

20 Claims, 8 Drawing Sheets

(56) References Cited

U.S. PATENT DOCUMENTS

| | | | | |
|---|---|---|---|---|
| 2009/0069522 | A1 | 3/2009 | Hessefort et al. | |
| 2010/0093598 | A1* | 4/2010 | Davio et al. | 510/466 |
| 2010/0233104 | A1 | 9/2010 | Drake et al. | |
| 2012/0329701 | A1* | 12/2012 | Paul | 510/513 |
| 2013/0309498 | A1* | 11/2013 | Chao et al. | 428/402 |
| 2013/0327364 | A1 | 12/2013 | Delbrassinne et al. | |
| 2015/0038388 | A1 | 2/2015 | Gallez et al. | |

FOREIGN PATENT DOCUMENTS

| | | | |
|---|---|---|---|
| EP | 0496510 | | 7/1992 |
| EP | 0685250 | | 12/1995 |
| EP | 0811584 | | 12/1997 |
| EP | 1075863 | | 8/2000 |
| EP | 1075864 | | 2/2001 |
| JP | 08192001 | A | 7/1996 |
| JP | 2002053440 | | 2/2002 |
| JP | 5282353 | | 9/2013 |
| WO | WO91/00763 | | 1/1991 |
| WO | WO9932539 | | 7/1999 |
| WO | WO02/44312 | | 6/2002 |
| WO | WO2004047779 | | 6/2004 |
| WO | WO2005/058454 | | 6/2005 |
| WO | WO2005/058455 | | 6/2005 |
| WO | WO2006063483 | | 6/2006 |
| WO | WO2008/145423 | | 12/2008 |
| WO | WO2008/152042 | | 12/2008 |
| WO | WO2012134651 | | 10/2012 |
| WO | WO2013122619 | A1 | 8/2013 |

OTHER PUBLICATIONS

International Search Report, PCT/US2012/050977, dated Nov. 16, 2012, 3 pages.

International Written Opinion, PCT/US2012/050977, dated Nov. 16, 2012, 6 pages.

R.P. Woodward Surface Tension Measurements Using the Drop Shape Method, dated prior to Aug. 2012, 6 pages.

Farn, Richard J. Chemistry and Technology of Surfactants: 2006. Google Books. Accessed Jun. 2015.

Wu, Wen-Zhong. Environmental Behavior and Ecotoxicological Impact of Persistent Organic Pollutants (POP) in Wildlife, with Special Emphasis on the Aquatic Ecosystem. Germany, 1999. Google Books. Web. Apr. 2016.

English language abstract and machine assisted English translation for JP08192001 extracted from http://www4.ipdl.inpit.go.jp/ database, 49 pages.

English language abstract and machine assisted English translation for JP2002053440 extracted from http://www4.ipdl.inpit.go.jp/ database, 43 pages.

English language abstract for DE102006044839 extracted from http://www.worldwide.espacenet.com database on Jan. 11, 2016, 1 page.

International Search Report, PCT/US2012/025474, dated Jun. 1, 2012, 4 pages.

International Search Report, PCT/EP2014/066875, dated Nov. 21, 2014, 4 pages.

Kuo, Dr. Alex C.M., Dow Corning Corporation, "Silicone Release Coatings for the Pressure Sensitive Industry-Overview and Trends; Part I—An Introduction to Silicone", May 2004, pp. 1-4.

Schwartz, et al, "Surface-Active Agents and Detergents," vols. I and II.

"Solid Surface Energy Data (SFE) for Common Polymers", http://www.surface-tension.de/solid-surface-energy.htm, last updated Nov. 20, 2007, printed Mar. 21, 2014, 2 pages.

Surface Energy Data for PDMA: Polydimethylsiloxane, CAS #9016-00-6, Diversified Enterprises, 2009, 1 page.

* cited by examiner

GRANULATED FOAM CONTROL AGENT FOR THE RINSE CYCLE USING SILOXANE WAX

This application is the National Stage of International Patent Application No. PCT/US2012/050977 filed on Aug. 15, 2012, which claims the benefit of priority of International Patent Application No. PCT/US2012/025474 as filed on Feb. 16, 2012, the contents of each of which are incorporated herein by reference in their entireties.

FIELD OF THE INVENTION

This invention relates to foam control agents for use in laundry detergents and other detergent compositions (e.g., personal care detergent compositions) including the foam control agents. The foam control agents of the embodiments of the present invention can be added to detergent compositions to inhibit unwanted foaming when the detergent is used in washing.

BACKGROUND OF THE INVENTION

Washing of clothes by hand or in semi-automatic machines is widespread in many countries; seventy percent of the world's population still wash their clothes in this way. When doing so, consumers usually like to see a lot of lather (foam) as they associate foaming with detergent efficiency. However, removing the lather requires numerous rinses, generally three or more rinses, which costs a lot of effort and wastes water.

Most foam control agents are designed for use in automatic washing machines. They are active in the washing stage to avoid overflow of foam. They are less suitable for hand washing applications as they eliminate or greatly reduce the lather in the washing stage. A foam control agent that would not greatly reduce the foam level in the washing stage but would cause fast defoaming in the rinse would allow saving of significant quantities of water and reduce the time and efforts needed for rinsing.

According to the present inventive concepts, a new antifoam has been devised which is active in diluted surfactant concentration and which is inactive in concentrated surfactant solution. It will be appreciated that the main difference between the washing stage and the rinse stage of a wash process is the surfactant concentration.

SUMMARY OF THE INVENTION

According to one embodiment, a granulatedantifoam composition comprises an antifoam, a siloxane wax binder, and a carrier. The antifoam includes a hydrophobic fluid wherein the hydrophobic fluid has a surface tension which is greater than or approximately equal to the dynamic surface tension of an aqueous dispersion of the detergent at above the critical micelle concentration of the surfactant and less than about 62 mN/m. The antifoam further includes a finely divided solid hydrophobic filler dispersed in the hydrophobic fluid.

According to one process, a method of forming a granulated antifoam formulation includes combining a hydrophobic filler and a hydrophobic fluid to form an antifoam, wherein the hydrophobic fluid has a surface tension that is greater than or approximately equal to the dynamic surface tension of an aqueous dispersion of the detergent at above the critical micelle concentration of the surfactant and less than about 62 mN/m. The method further includes granulating the antifoam by depositing the antifoam and a siloxane wax binder onto a carrier.

According to another process, a method of washing a substrate includes applying a detergent composition to the substrate. The detergent composition includes a surfactant and a granulatedantifoam composition. The granulated antifoam composition comprises (a) an antifoam including hydrophobic fluid and a finely divided solid hydrophobic filler dispersed in the hydrophobic fluid, (b) a siloxane wax binder, and (c) a carrier. The method further includes washing the substrate in an aqueous medium with the detergent composition, whereby the antifoam does not substantially affect foaming during the act of washing. The method further includes rinsing the substrate with the applied detergent composition with water, whereby foaming during the rinsing step is inhibited.

Additional aspects of the invention will be apparent to those of ordinary skill in the art in view of the detailed description of various embodiments, a brief description of which is provided below.

BRIEF DESCRIPTION OF THE DRAWINGS

The foregoing and other advantages of the invention will become apparent upon reading the following detailed description and upon reference to the drawings.

Figure 1A:
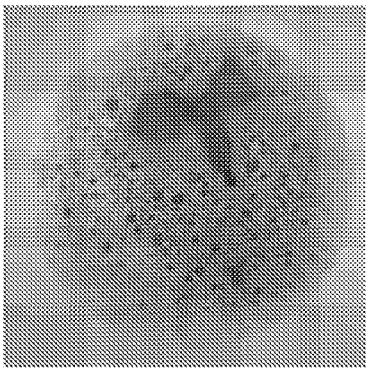
FIG. 1*a* is a photograph showing one example of a foam level having rating of about 1.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DETAILED DESCRIPTION

The granulated antifoam composition according to the inventive concepts comprises (I) an antifoam comprising (a) a hydrophobic fluid and (b) a finely divided solid hydrophobic filler dispersed in the hydrophobic fluid, (II) a siloxane wax which is selected as a binder for the agglomeration process, and (III) a carrier.

Hydrophobic Fluid

The hydrophobic fluid (a) has a surface tension which is greater than or approximately equal to the dynamic surface tension of an aqueous dispersion of the detergent at above the critical micelle concentration of the surfactant but is less than 62. By 'greater than or approximately equal to the dynamic surface tension of an aqueous dispersion of the detergent at above the critical micelle concentration', it is intended that the static surface tension of the hydrophobic fluid is at least 95% of the dynamic surface tension of an aqueous dispersion of the detergent at above the critical micelle concentration. In some embodiments, the hydrophobic fluid has a surface tension of at least 27 mN/m and less than 40 mN/m. The hydrophobic fluid having a surface tension between 27 and 40 mN/m does not contain any polar groups having active hydrogen that can be ionized in the aqueous medium with the detergent composition. Such groups are, for example, carboxylic, sulfonate, sulfate, amide or phosphate.

The surface tension of the hydrophobic fluid (a) is measured by the drop shape method. In this test, a drop of pure antifoam compound is made in air by using a syringe and the surface tension is calculated from measurements of the pendant drop curvature. The drop shape test method is explained in the paper 'Surface tension measurements using the drop shape method' by R. P. Woodward published by First Ten Angstroms of 465 Dinwiddie Street, Portsmouth, Va., U.S.A. The surface tension of the antifoam measured by the drop shape method may be regarded as the static surface tension. This is less representative of the use of the antifoam in the washing and rinsing process, but any attempt to measure the dynamic surface tension of the antifoam alone will also be unrepresentative of the use of the antifoam in the washing and rinsing process. All surface tension measurements specified herein (both dynamic surface tension measurements and static surface tension measurements) are surface tensions at 25° C.

It is believed that an antifoam compound which has a much lower surface tension than the dynamic surface tension of the detergent solution will migrate quickly to the bubble interface and break the foam, as demonstrated in the wash by conventional antifoams used in laundry detergents. According the inventive concepts described herein, the foam inhibitor, which is based on a hydrophobic fluid having a surface tension greater than the surface tension of conventional antifoams used in laundry detergents, does not spread on the surface of concentrated surfactant solution and is ineffective to reduce foam in the washing stage when surfactant concentration is high. It is believed that an antifoam compound which has a surface tension greater than or approximately equal to the dynamic surface tension of the aqueous dispersion of the detergent in the wash, where the surfactant solution is above the critical micelle concentration, will migrate too slowly to the bubble interface and will hardly break the foam.

Once the detergent solution is diluted below the critical micelle concentration of the surfactant, the surface tension of the solution increases and becomes higher than the antifoam surface tension. Migration of the surfactant to the bubble interface becomes less effective below the critical micelle concentration. This happens in the rinse cycle. Surprisingly, it was been observed that despite dilution of the antifoam by removal of washing liquor and replacement with fresh water in each rinsing step, the antifoam of the inventive concepts is still effective at the rinsing stage. Migration of antifoam to the bubble interface competes effectively with migration of the surfactant, and the antifoam starts to be effective.

The invention includes a fabric washing process comprising washing a fabric in an aqueous dispersion of a detergent composition according to the invention as defined above at a concentration of surfactant in the aqueous dispersion above the critical micelle concentration, and subsequently rinsing the fabric in water wherein the concentration of surfactant is below the critical micelle concentration.

The hydrophobic fluid (a) used in the antifoam can, for example, be a fluid organopolysiloxane. Fluid organopolysiloxanes are well known as antifoams, but the fluid organopolysiloxanes commonly used as antifoams generally have a surface tension below 27 mN/m. Polydimethylsiloxane, for example, has a surface tension of 21 mN/m.

The invention includes the use of a composition comprising (a) a hydrophobic fluid organopolysiloxane having a surface tension of at least 27 mN/m and less than 40 mN/m, and (b) a finely divided solid hydrophobic filler dispersed in the hydrophobic fluid, to inhibit foam in the rinsing step of a washing process. In particular, such a composition is used to inhibit foam in the rinsing step by incorporating the composition in the washing process, for example by adding it to the detergent composition used for washing.

A composition according to another aspect of the present concepts for inhibiting foam in the rinsing step of a washing process without substantially reducing foam in the washing step of the washing process comprises (I) an antifoam including (a) a fluid organopolysiloxane and (b) a finely divided solid hydrophobic filler dispersed in the fluid organopolysiloxane, (II) a siloxane wax binder, and (III) a carrier. The organopolysiloxane fluid (a) may include a carboxyalkyl fluid, e.g., including pendant esterified carboxyalkyl groups.

One type of hydrophobic fluid that may be used is a fluid organopolysiloxane. The fluid organopolysiloxane may have a surface tension of at least 27 mN/m and may include pendant esterified carboxyalkyl groups. The fluid organopolysiloxane containing pendant esterified carboxyalkyl groups can, for example, be a substantially linear polydiorganosiloxane or can be a branched organopolysiloxane containing for example up to 10 mole % branching units. The carboxalkyl groups can, for example, contain 2 to 12 carbon atoms, particularly 2 to 5 carbon atoms, and can, for example, be carboxymethyl, 2-carboxyethyl, 2-methyl-2-carboxyethyl or 2-ethyl-2-carboxyethyl groups. The carboxyalkyl groups can be esterified by alkyl, aryl, aralkyl or cycloalkyl groups, for example the carboxyalkyl groups can each be esterified by an alkyl group having 1 to 20 carbon atoms. In one embodiment, all or most of the carboxyalkyl groups are esterified by an alkyl group having about 8 to about 18 carbon atoms, for example a n-octyl, 2-ethylhexyl, lauryl, tetradecyl, hexadecyl or stearyl group. A mixture of different alkyl groups, for example alkyl groups of different chain length, can be used such as a mixture of $C_{12}$ and $C_{14}$ alkyl groups.

In one embodiment, at least 10% of the siloxane units in an organopolysiloxane fluid carry a pendant esterified carboxyalkyl group, for example 25 to 100% of the siloxane units may carry a pendant esterified carboxyalkyl group. Other substituents in the organopolysiloxane can, for example, be selected from alkyl groups having 1 to 20 carbon atoms and phenyl groups. The organopolysiloxane can be prepared by reaction of an organopolysiloxane containing Si—H groups with an ester of an ethylenically unsaturated carboxylic acid, for example an acrylate or methacrylate, in the presence of a hydrosilylation catalyst. The organopolysiloxane containing Si—H groups can, for example, be poly(methylhydrogensiloxane) or a dimethylsiloxane methylhydrogensiloxane copolymer, so that in many cases most or all of the siloxane groups in the organopolysiloxane contain a methyl substituent.

In one embodiment, the fluid organopolysiloxane containing pendant esterified carboxyalkyl groups also has pendant alkyl substituents having about 2 to about 20 carbon atoms in addition to esterified carboxyalkyl groups and methyl groups. Such alkyl substituents can, for example, be ethyl, hexyl, octyl, lauryl, tetradecyl, hexadecyl or stearyl substituents. In one embodiment, the fluid organopolysiloxane contains alkyl substituents having about 8 to about 18 carbon atoms bonded to Si atoms of the organopolysiloxane as well as methyl groups and carboxyalkyl groups esterified by an alkyl group having about 8 to about 18 carbon atoms. The fluid organopolysiloxane can, for example, be prepared by reacting poly(methylhydrogensiloxane) or a dimethylsiloxane methylhydrogensiloxane copolymer with a mixture of one or more alpha-alkene having 8 to 18 carbon atoms and one or more 8-18C alkyl methacrylate or acrylate ester, such as a mixture of $C_{12}$ to $C_{14}$ alkenes and $C_{12}$ to $C_{14}$ alkyl methacrylates. The molar ratio of pendant esterified carboxyalkyl groups to pendant alkyl substituents having 2 to 20 carbon atoms can, for example, be in the range 10:1 to 1:2, with each siloxane unit generally containing a methyl group. A substantially linear polydiorganosiloxane comprising methyl $C_{12-14}$ alkyl siloxane units and methyl 2-methyl-2-carboxyethyl siloxane units in substantially equimolar amounts, in which the carboxyethyl groups are esterified by $C_{12-14}$ alkyl groups has a surface tension of 27.2 mN/m.

A composition according to another aspect of the present concepts for inhibiting foam in the rinsing step of a washing process without substantially reducing foam in the washing step of the washing process comprises: (I) an antifoam including (a) a fluid organopolysiloxane, (b) a finely divided solid hydrophobic filler dispersed in the fluid organopolysiloxane; (II) a siloxane wax binder; and (III) a carrier. The fluid organopolysiloxane (a) may be a phenyl organopolysiloxane fluid such as, for example, a trimethylsiloxy-terminated poly(phenylmethylsiloxane).

An alternative type of fluid organopolysiloxane which has a surface tension of at least about 27 mN/m and is suitable for use in embodiments of the present invention is a fluid organopolysiloxane containing aryl groups, e.g., phenyl groups, bonded to silicon. The aryl organopolysiloxane can, for example, be a substantially linear polydiorganosiloxane or can be a branched organopolysiloxane containing for example up to 10 mole % branching units. Organopolysiloxanes having a phenyl group bonded to substantially all the silicon atoms of the organopolysiloxane are particularly effective. One example of such an organopolysiloxane is a poly(methylphenylsiloxane). One trimethylsiloxy-terminated poly(methylphenylsiloxane), known as a heat transfer fluid, has a surface tension of 27.1 mN/m. A silanol-terminated poly(methylphenylsiloxane) of similar molecular weight has a surface tension of 33.9 mN/m. Another poly (methylphenylsiloxane), described in Example 1 of WO-2008/152042, has a surface tension of 32.8 mN/m. All of these fluid organopolysiloxanes containing phenyl groups are suitable for use in embodiments of the present invention as hydrophobic fluid of the antifoam.

The hydrophobic fluid included in the antifoam compositions of the embodiments of the present invention can alternatively be an organic fluid containing no silicon. It can, for example, be an organic fluid. For example, the hydrophobic fluid can be a hydrocarbon fluid such as a liquid polyisobutylene or polybutene. The liquid polyisobutylene sold by Univar® (The Netherlands) under the trade mark DYNAPAK POLY™ 55, having a surface tension of 30.4 mN/m, is one non-limiting example of a suitable organic hydrophobic fluid. Another non-limiting example of a suitable organic polybutene is INDOPOL® H25 (polybutene hydrophobic oil) sold by INEOS® (Lyndhurst, United Kingdom).

Alternative organic hydrophobic fluids which is suitable for use as the hydrophobic fluid (a) in the antifoam in the embodiments of the present invention are polyethers in which the repeating ether unit has at least 3 carbon atoms, for example polypropylene oxide, polybutylene oxide or polytetramethylene oxide. Polypropylene oxide has a surface tension of 29.0 mN/m.

The hydrophobic fluid of the embodiments of the present invention may include any fluids described herein, any other suitable hydrophobic fluids, or any combinations thereof.

Hydrophobic Filler

The foam control composition contains a hydrophobic filler (b) dispersed in the polydiorganosiloxane fluid. Hydrophobic fillers for foam control agents are well known and are particulate materials which are solid at 100° C., such as silica, which, according to one embodiment, has a surface area as measured by BET measurement of at least about 50 $m^2/g$, titania, ground quartz, alumina, an aluminosilicate, zinc oxide, magnesium oxide, a salt of an aliphatic carboxylic acids, a reaction product of an isocyanate with an amine, e.g. cyclohexylamine, or an alkyl amide such as ethylenebisstearamide or methylenebisstearamide. Mixtures of two or more of these can be used.

Some of the fillers mentioned above are not hydrophobic in nature, but can be used if made hydrophobic. This can be done either in situ (i.e. when dispersed in the polysiloxane fluid), or by pre-treatment of the filler prior to mixing with the polysiloxane fluid. One example of a suitable filler is silica that has been made hydrophobic. Suitable silica materials include those that are prepared by heating, e.g. fumed silica, or precipitation. The silica filler may, for example, have an average particle size of about 0.5 to about 50 μm, alternatively about 2 to about 30, and alternatively about 5 to about 25 μm. It can be made hydrophobic by treatment with a fatty acid or by the use of methyl substituted organosilicon materials such as dimethylsiloxane polymers, which are end-blocked with silanol or silicon-bonded alkoxy groups, hexamethyldisilazane, hexamethyldisiloxane or organosilicon resins containing $(CH_3)_3SiO_{1/2}$ groups and silanol groups. Hydrophobing is generally carried out at a temperature of at least 100° C. Mixtures of fillers can be used, for example a highly hydrophobic silica filler such as that sold under the trademark SIPERNAT® D10 from Evonik Industries (Germany) can be used together with a partially hydrophobic silica such as that sold under the trademark AEROSIL® R972 from Evonik Industries.

The amount of hydrophobic filler (b) in the foam control composition of embodiments of the invention may be about 0.5-50% by weight based on the hydrophobic fluid (a), alternatively from about 1-15% by weight, and alternatively about 2-8% by weight.

Optional Organosilicon Resin

The antifoam compositions of the embodiments of the present invention may optionally include one or more organosilicon resins. The organosilicon resin may be a non-linear siloxane resin. In one embodiment, the organosilicon resin includes siloxane units having the formula $R'_aSiO_{(4-a)/2}$, wherein R' denotes a hydroxyl, hydrocarbon, or hydrocarbonoxy group, and wherein a has an average value of from about 0.5 to about 2.4. In one embodiment, the organosilicon resin includes monovalent trihydrocarbonsiloxy (M) groups of the formula $R''_3SiO_{1/2}$ and tetrafunctional (Q) groups SiO4/2, wherein R" denotes a monovalent hydrocarbon group. In one embodiment, the M/Q ratio is in the range about 0.4:1 to about 2.5:1 (equivalent to the value of a in the formula $R'_aSiO_{(4-a)/2}$ of about 0.86 to about 2.15) for use in laundry detergent applications. In another embodiment, the M/Q ratio is from about 0.4:1 to about 1.1:1 for use in laundry detergent applications. In yet another embodiment, M/Q ratio about 0.5:1 to about 0.8:1 (equivalent to the value of a in the formula $R'_aSiO_{(4-a)/2}$ of about 1.0 to about 1.33) for use in laundry detergent applications.

The organosilicon resin described herein is generally a solid at room temperature. However, it is contemplated that liquid organosilicon resins (e.g., those having a M/Q ratio greater than about 1.2) may also be used.

The organosilicon resin typically includes only M and Q groups, as described above. However, it is contemplated that a resin comprising M groups, trivalent $R''SiO_{3/2}$ (T) groups and Q groups may also or alternatively be used. The organosilicon resin may also include divalent units $R''_2SiO_{2/2}$, e.g., in an amount of about 20% or less of all siloxane units present. The group R" may comprise an alkyl group (e.g., methyl, ethyl, or phenyl) having from about 1 to about 6 carbon atoms. It may be desirable that about 80% to substantially all of the R" groups present be methyl groups. Other hydrocarbon groups may also be present including, but not limited to, alkenyl groups such as dimethylvinylsilyl units (e.g., not exceeding about 5% of the total R" groups). Silicon-bonded hydroxyl groups and/or alkoxy, (e.g. methoxy) groups may also be present. Such organosilicon resins are generally well known and can be made in solvent or in situ, e.g., by hydrolysis of certain silane materials. In one embodiment, the organosilicon resin is made by hydrolysis and condensation in the presence of a solvent (e.g. xylene) of a precursor of the tetravalent siloxy unit (e.g. tetra-orthosilicate, tetraethyl orthosilicate, polyethyl silicate or sodium silicate), and a precursor of monovalent trialkylsiloxy units (e.g. trimethylchlorosilane, trimethylethoxysilane, hexamethyldisiloxane, or examethyldisilazane). The resulting MQ resin may, if desired, be further trimethylsilylated so that it is reacted out. Residual Si—OH groups may be heated in the presence of a base to cause self-condensation of the resin by elimination of Si—OH groups.

Siloxane Wax Binder

The foam-inhibiting composition of the embodiments of the present invention is in granule form. The foam-inhibiting composition is generally supported on a particulate carrier that is agglomerated into granules by a binder. The binder may include a material that may be applied to the carrier as a liquid binding medium and that can be solidified to bind the carrier particles together. The binder may include a material that, at room temperature (e.g. from about 20° C. to about 25° C.) has a solid consistency, e.g., a waxy material having a melting point from about 35° C. to about 100° C.

The granulated antifoam compositions according to the embodiments of the present invention include a binder or encapsulant that is a siloxane wax having a melting point between about 30° C. to about 100° C. The siloxane waxes of the embodiments of the present invention can be, for example, alkyl-functional silicone wax, alkyl-functional silanes, amine-functional silicone wax, amide-functional silicone wax, and any combination thereof. These siloxane waxes comprise at least one C12 to C80 alkyl group. In one embodiment the siloxane wax includes at least one C16 to C54 alkyl group. In another embodiment, the siloxane wax includes at least one C18 to C30 alkyl group. The siloxane wax in the present invention may be cyclic, linear, branched, and/or may include siloxane Q units. The alkyl group may be in a terminal position or in a side position of the silicone polymer chain. Examples of siloxane waxes include, but are not limited to, dimethyl, methyoctadecylsiloxane, trimethylterminated polysiloxane, and trimethylstearyloxysilane or alkyl ester modified silicone wax. The siloxane wax, which may be obtained by a hydrosilylation reaction between SiH-containing siloxane and 1-alkene, provides the appropriate physical properties to the granulated antifoam and improves its defoaming performance in the rinse. When used in the compositions of the embodiments of the present invention, the siloxane wax was found to cause additional defoaming efficiency.

Combination of Siloxane Wax with Organic Binders

Conventional organic waxes used as binders or film forming agents (e.g., fatty alcohols, fatty alcohols ethoxylate, fatty acids, fatty acids esters, polyethylene glycols, polyol esters fully or partially esterified by carboxylated groups esters of glycerides) failed to produce the level of performance obtained using an alkyl siloxane wax. Antifoam granules having a combination of siloxane wax with organic binders were found to be effective in controlling the foam in the rinse cycle of a washing process. Thus, granulated antifoam compositions including a combination of siloxane wax with organic binder were also shown to be improved granulated antifoams.

These organic binders can be applied to the carrier described below in a molten state and can be solidified by cooling to agglomerate the carrier. The binder may, for example, be present in the foam-inhibiting granules at about 10 to about 200% by weight based on the hydrophobic foam-inhibiting fluid, alternatively at about 20 to about 120% by weight based on the foam-inhibiting fluid. The weight ratio of siloxane wax to organic wax binder may be from about 5:1 to about 1:5 or, in another embodiment, from about 3:1 to about 1:3.

Carriers

The carriers may be used in the embodiments of the present invention include water soluble carriers. Alternatively, the carriers may be water-insoluble and/or water dispersible. Suitable examples of carrier particles include silica, silicates, aluminosilicates, carbonates, sulfates, phosphates (e.g., sodium triphosphate), sodium perborate, and oxides. Examples of preferred silica particles include diatomaceous earth, calcined diatomaceous earth, quartz, sand and silica fume. Examples of preferred silicates and aluminosilicates include magnesium silicate, zeolite, metakaolin, feldspar, talc, sepiolite, wollastonites, phyllosilicates such as mica and clay materials such as bentonite. Examples of preferred carbonates include calcium carbonates, sodium carbonate, sodium bicarbonate, magnesium carbonate and dolomite. Examples of preferred sulfates include calcium sulfate, gypsum, sodium sulfate, magnesium sulfate and iron sulfate. Examples of preferred oxides and oxide materials include alumina, titanium dioxide, magnesium oxide, lime, cement, and calcium hydroxide, Further examples of suitable carrier particles include organic materials such as starch, granulated starch, rice starch, native starch, calcinated rice and starch residues (e.g. Rice Hulls ash), sodium citrate, sodium sesquicarbonate, methyl cellulose, carboxy methyl cellulose, cellulose derivatives (e.g., sodium carboxymethylcellulose), polystyrene beads, polyacrylate beads, sodium acetate, peat, wood flour, sugar and sugar derivatives, corn cob, and industrial products or by-products such as fly ash or slag. The mean particle size of the carrier may be in the range about 0.2 μm to about 1000 μm, alternatively from about 0.2 μm to about 50 μm, alternatively from about 1 μm to about 10 μm. The carrier particles generally form from about 40% by weight to about 90% by weight of the granulated product, alternatively from about 60% by weight to about 90%. The foam-inhibiting hydrophobic fluid generally forms from about 5% by weight to about 50% by weight of the granulated product, alternatively from about 5% by weight to about 25% by weight of the granulated product.

Process of Making

The foam-inhibiting granules of the embodiments of the present invention may be formed using an agglomeration process. The antifoam, comprising hydrophobic fluid or combination of hydrophobic fluids, is mixed with finely divided solid hydrophobic particles, which are dispersed using adequate stirring/mixing equipment or a homogenizer. The antifoam composition is then dispersed into the siloxane wax at a temperature at which the siloxane wax is liquid. While keeping the temperature above the melting point of the siloxane wax, the resulting molten liquid mixture is then deposited or sprayed onto carrier particles while agitating the particles and cooling the mixture. Alternatively, the antifoam composition and the siloxane wax may be deposited or sprayed separately onto carrier particles, or the silicone wax may be added by post coating on the granulated carrier.

The particles may, for example, be agitated in a high shear mixer through which the particles pass continuously. One type of suitable mixer is a vertical, continuous high shear mixer in which the foam inhibiting fluid and the binder in a liquid state are sprayed onto the particles. One example of such a mixer is a Flexomix mixer supplied by Hosokawa Schugi. Alternative suitable mixers include horizontal high shear mixers, in which an annular layer of the powder—liquid mixture is formed in the mixing chamber, with a residence time of a few seconds up to about 2 minutes. Examples of this family of machines are pin mixers (e.g. TAG series supplied by LB, RM-type machines from Rubberg-Mischtechnik or pin mixers supplied by Lodige), and paddle mixers. Other suitable mixers include Glatt granulators, ploughshare mixers, as sold for example by Lodige GmbH, twin counter-rotating paddle mixers, known as Forberg-type mixers, and intensive mixers including a high shear mixing arm within a rotating cylindrical vessel.

Alternative Process

In an alternative process, an antifoam mixture comprising hydrophobic fluid and hydrophobic filler are emulsified in water, and the resulting aqueous emulsion is deposited on carrier particles. The siloxane wax binder is deposited separately on the carrier, either simultaneously with or after the deposition of the antifoam emulsion. The supported foam control composition may additionally include a water-soluble or water-dispersible binder to improve the stability of the particles.

In addition to the silicone wax binder, a further binder may be added to provide enhanced handling stability, if so desired. Examples of suitable binders include, but are not limited to, polycarboxylates (e.g., polyacrylic acid or a partial sodium salt thereof), a copolymer of acrylic acid (e.g., a copolymer with maleic anhydride), polyoxyalkylene polymers (e.g., polyethylene glycol) that can be applied molten or as an aqueous solution and spray dried, reaction products of tallow alcohol and ethylene oxide, cellulose ethers (e.g., water-soluble or water-swellable cellulose ethers such as sodium carboxymethylcellulose, or sugar syrup binders such as Polysorb 70/12/12 or LYCASIN® 80/55 HDS (Roquette, Lestrem, France) maltitol syrup or Roclys C1967 S maltodextrin solution), any combination thereof, or the like.

The water-soluble or water-dispersible binder may be mixed with the foam control composition before being deposited on the carrier, or it may be separately deposited on the carrier particles.

The supported foam control composition may optionally contain a surfactant to aid dispersion of the foam control composition in the binder and/or to help in controlling the foam profile, that is, in ensuring that some foam is visible throughout the wash without overfoaming. Examples of suitable surfactants include silicone glycols, fatty alcohol ether sulfate, or linear alkylbenzene sulfonate which may be used with a polyacrylic acid binder. The surfactant may be added to the foam control composition in an undiluted form before the silicone is deposited on the carrier, or the surfactant can be added to the binder and deposited as an aqueous emulsion on the carrier.

Foam inhibiting granules generally have a mean particle diameter of at least about 0.1 mm (e.g., over about 0.25 or about 0.5 mm), up to a mean diameter of about 1.2 or about 1.5 or even about 2 mm. Granules according to the invention of this particle size, particularly about 0.5 to about 1 mm, have good flow properties and resistance to compaction.

Granulation processes that may be used in the embodiments of the present invention are generally known, and include those described in EP 0811584 and EP 496510.

Use in Laundry Detergents (Powder)

The granulated antifoam composition of the embodiments of the present invention may be added to a detergent composition at a level from about 0.1 to about 10% by weight of the detergent composition. In one embodiment, the granulated antifoam composition is added at a level of from about 0.4 to about 5% by weight.

The detergent composition of the embodiments of the present invention may be a laundry detergent, but can alternatively be a detergent for dish washing or a detergent composition for personal care, such as a shampoo, shower gel, or soap bar. In all of these applications, the consumer may prefer to see lather during the washing step but rapid defoaming in the rinsing step.

The detergent composition may comprise at least one detersive surfactant, which may be chosen from soap and non-soap anionic, cationic, nonionic, amphoteric, and zwitterionic detergent-active surfactants, or mixtures thereof. Many suitable detergent-active surfactants are available and are fully described in the literature, for example, in "Surface-Active Agents and Detergents", Volumes I and II, by Schwartz, Perry and Berch. In one embodiment, the detersive surfactant includes soaps and/or synthetic non-soap anionic and/or nonionic compounds. The total amount of surfactant present is generally within the range of from about 5 to about 40 wt % of the detergent composition.

Examples of anionic surfactants include alkylbenzene sulfonates, particularly linear alkylbenzene sulfonates having an alkyl chain length of about 8 to about 16 carbon atoms; primary and secondary alkyl sulfates, particularly primary alkyl sulfates having an alkyl chain length of about 8 to about 16 carbon atoms; alkyl ethersulfates; olefin sulfonates; alkyl xylene sulfonates; dialkyl sulfosuccinates; and fatty acid ester sulfonates. Sodium salts may also be used. The detergent composition may include an anionic surfactant, optionally, with a nonionic surfactant.

Nonionic surfactants that may be used include primary and secondary alcohol ethoxylates, including aliphatic alcohols having about 8 to about 20 carbon atoms ethoxylated with an average of from about 1 to about 20 moles (e.g., about 1 to about 10 moles) of ethylene oxide per mole of alcohol. Suitable non-ethoxylated nonionic surfactants include alkylpolyglycosides, glycerol monoethers, and polyhydroxyamides.

Examples of cationic organic detergent surfactants include alkylamine salts, quaternary ammonium salts, sulfonium salts, and phosphonium salts.

The detergent compositions of the embodiments of the present invention may also include one or more detergency builders. The total amount of detergency builder in the composition may range from about 5 to about 80 wt %, alternatively from about 10 to about 60 wt %. Inorganic builders that may be present include sodium carbonate, crystalline and amorphous aluminosilicates (e.g., zeolites), and layered silicates. Inorganic phosphate builders (e.g., sodium orthophosphate, pyrophosphate, and tripolyphosphate) may also be present. Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulfonated fatty acid salts. Builders—both inorganic and organic—may be present in alkali metal salt (e.g., sodium salt) form.

The detergent composition of the embodiments of the present invention may also include a peroxy bleach compound (e.g., an inorganic persalt or an organic peroxyacid) capable of yielding hydrogen peroxide in aqueous solution. Suitable inorganic persalts include sodium perborate monohydrate and tetrahydrate and sodium percarbonate. The peroxy bleach compound may be used in conjunction with a bleach activator (bleach precursor), for example a peroxycarboxylic acid precursor, and, more especially a peracetic acid precursor such as tetraacetyl ethylenediamine, or a peroxybenzoic acid or peroxycarbonic acid precursor.

Detergent compositions intended for personal care use (e.g., shampoo compositions) may contain other ingredients such as conditioners to facilitate combing and/or styling of the hair and/or to improve the shine and/or softness of the hair, perfumes, fragrances, colorants such as dyes, essential oils, vitamins, buffering agents, stabilizers, and preservatives, any combination thereof, or the like.

The detergent composition of embodiments of the invention may be in powder form, tablet form, or in the form of a solid bar (soap bar). Laundry detergents for hand washing or for use in semi-automatic machines are commonly sold in powder form. Detergent powders can, for example, be prepared by spray-drying a slurry of compatible heat insensitive ingredients or by mixing and granulating raw materials, e.g., using a high-speed mixer/granulator. Less robust or more heat sensitive ingredients can be subsequently incorporated into the detergent powder; the foam-inhibiting composition of the embodiments of the present invention may subsequently be incorporated in this way.

For use in shampoo, laundry liquid detergent or liquid dishwashing detergent the foam control agent may be in an emulsion form, e.g., an oil-in-water emulsion. The emulsions may be macro-emulsions or micro-emulsions. In general, they comprise the foam control agent as the disperse phase, one or more surfactants, water and standard additives, such as preservatives, viscosity modifiers and thickeners. The surfactants may be selected from anionic, cationic, nonionic or amphoteric materials as described above. The concentration of the foam control agent in the emulsion can, for example, be about 10 to about 60%, alternatively about 25 to about 60%.

The hydrophobic foam inhibiting fluid (a) is generally present in the detergent composition at about 0.01 to about 2% by weight, alternatively about 0.03 to about 0.2% by weight of the detergent composition. A granulated foam control composition according to the invention is typically added to detergent powders at about 0.1 to about 10% by weight, alternatively about 0.2 to about 0.5 or about 1.0%.

EXAMPLES/MATERIALS DESCRIPTION

"Polysiloxane A" referred to below is a substantially linear polydiorganosiloxane of about 1200 cSt viscosity comprising methyl $C_{12-14}$ alkyl siloxane units and methyl 2-methyl-2-carboxyethyl siloxane units in substantially equimolar amounts, in which the carboxyethyl groups are esterified by $C_{12-C13}$ alkyl groups.

"Wax A" referred to below is a dimethyl methyloctadecyl siloxane trimethylsiloxy-terminated organopolysiloxane.

"Wax B" referred to below is a trimethylstearyloxysilane and stearyl alcohol.

The dental high sheer speed mixer used in the examples below was a SPEEDMIXER™ DAC mixer (RohChem BV, Naarden, Netherlands).

These examples are intended to illustrate the invention to one of ordinary skill in the art and should not be interpreted as limiting the scope of the invention set forth in the claims. All parts and percentages in the examples are on a weight basis and all measurements were indicated at about 25° C., unless indicated to the contrary.

Example 1

The foaming properties of commercial hand wash detergents were compared to the foaming properties of those commercial hand wash detergents with granulated antifoams of the embodiments of the present invention added thereto. The commercial hand wash detergents used in this example were (a) Ariel® (Procter & Gamble Co., Cincinnati, Ohio), (b) SURF EXCEL™ (Unilever, London, United Kingdom), and (c) LIBY® (Guangzhou Liby Enterprise Group Co. Ltd., Guangzhou, China).

Two types of granulated antifoams were made. Granulated Antifoam A was made as follows. About 91 g of Polysiloxane A was mixed with about 6 g of CAB-O-SIL® TS-530 (Cabot Corporation, Boston, Mass.) and about 3 g of AEROSIL® R972 (Evonik, Essen, Germany) in a dental high shear speed mixer. About 40 g of the resulting antifoam compound was mixed with about 40 g of Wax A at a temperature of about 60° C. The resulting mixture was then sprayed onto about 200 g of sodium sulfate. The spraying was stopped when the powder was agglomerated into granules of about 400-600 μm. The quantity of liquid sprayed was then recorded in order to calculate the level of antifoam in the granule. The granules contained about 7.84% of compound.

Granulated Antifoam B was made as follows. About 40.5 g of Polysiloxane A was mixed with about 40.5 g of INDOPOL® H25 (INEOS®, Lyndhurst, United Kingdom). The resulting fluid was then mixed with about 6 g of CAB-O-SIL® TS-530 and about 3 g of AEROSIL® R-972 in a dental high shear speed mixer. About 40 g of the resulting antifoam compound was mixed with about 20 g of Wax A and 20 g of LUTENSOL® AT 80 ($C_{16}$-$C_{18}$ fatty alcohol+80 EO) (BASF, Ludwigshafen, Germany) at a temperature of about 80° C. The resulting mixture was then sprayed onto about 200 g of sodium sulfate. The spraying was stopped when the powder was agglomerated into granules of about 400-600 μm. The quantity of liquid sprayed was then recorded in order to calculate the level of antifoam in the granule. The granule contained about 7.84% of compound.

Testing was performed to compare the foaming of each detergent powder by itself to the foaming of each of the detergent powders with the addition of the Granulated Antifoam A or B. The level of granulated antifoam was calculated based on the level of active antifoam in the granule: 0.1% active vs. detergent by weight.

About 8 g of each of Formulations (1A)-(1H) (see Table 1 below) was added to a separate bucket having about 2 liters of water at a temperature of about 30° C. and a water hardness of about 10 French degrees with a Ca/Mg ratio of about 4/1. Each solution was agitated smoothly for about 60 seconds in order to ensure that the formulation was dissolved. After that, the solution was whisked vigorously for about 5 seconds. The foam height was then recorded at three different places in the bucket, and the average and standard deviation on the readings was calculated.

For each solution, three pieces of cotton having dimensions of about 45 cm×70 cm (about 150 g) were immersed into the solution, lifted out, and then dipped two times. The cotton pieces were squeezed, one by one, until the weight of the wet cotton pieces reached about 450 g+/− about 5 g. The foam height was then recorded.

The cotton pieces were then soaked in a bucket of fresh water at a temperature of about 30° C. and a water hardness of about 10 French degrees, lifted out, and then dipped two times. The cotton pieces were squeezed, one by one, until the weight of the wet cotton pieces reached about 450 g. A picture was then taken at a fixed height on the top of the bucket. This operation was repeated a second time.

The foam height was recorded after the dissolution and washing steps described above. Higher foam heights are desirable, as the target is to avoid and/or prevent significant defoaming during these stages. It is considered that a foam decrease of 2 cm in dissolution or 1.5 cm in the wash will generally not be perceivable by consumers.

Figure 1B:
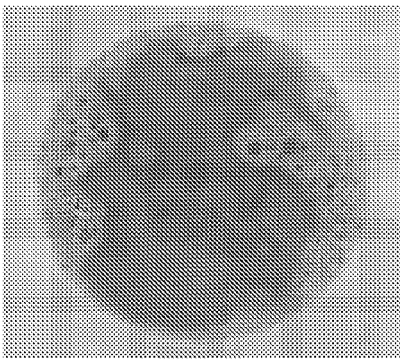
FIG. 1*b* is a photograph showing one example of a foam level having rating of about 3.
Figure 1C:
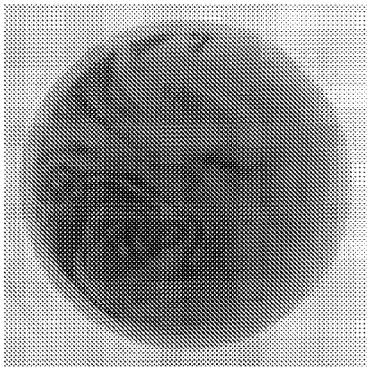
FIG. 1*c* is a photograph showing one example of a foam level having rating of about 7.

Results are presented as pictures taken from the top of the bucket at a fixed height after the first rinse (FIGS. 2*a*, 3*a*, 4*a*, 5*a*, 6*a*, 7*a*, 8*a*, 9*a*) and the second rinse (FIGS. 2*b*, 3*b*, 4*b*, 5*b*, 6*b*, 7*b*, 8*b*, 9*b*). A rinse rating was established to facilitate the interpretation of the results. This rating was based on a questionnaire completed by 45 panelists who rated a series of rinse photographs on a scale of 1 to 7-1 being a bad result, indicating that the panelists generally estimated that about 2 to 3 additional rinses would still be needed, and 7 being the best result, indicating that panelists generally believed no additional rinse was needed. Examples of photographs rated by the panelists are shown in FIGS. 1*a*-1*c*. The foaming of the photograph of FIG. 1*a* was rated a "1," indicating that 2-3 additional rinses were believed to still be needed. The foaming of the photograph of FIG. 1*b* was rated a "3," indicating that at least one additional rinse was believed to be needed. The foaming of the photograph of FIG. 1*c* was rated a "7," indicating that no additional rinse was believed to be needed.

The foam heights after dissolution and after washing are provided in Table 1 below.

TABLE 1

| Formulation | Detergent Powder | Foam Height After Dissolution (cm) | Foam Height After Wash (cm) | Rating After Rinse 2 |
|---|---|---|---|---|
| (1A) | Ariel ® | 6.7 | 4.1 | 2 |
| (1B) | Ariel ® with Granulated Antifoam A | 5.3 | 3.4 | 6 |
| (1C) | Ariel ® with Granulated Antifoam B | 6.1 | 3.2 | 6 |
| (1D) | SURF EXCEL ™ | 8.6 | 3.4 | 1 |
| (1E) | SURF EXCEL ™ with Granulated Antifoam A | 7.1 | 1.4 | 6-7 |
| (1F) | SURF EXCEL ™ with Granulated Antifoam B | 7.2 | 3.6 | 6-7 |
| (1G) | LIBY ® | 9.2 | 5.5 | 1 |
| (1H) | LIBY ® with Granulated Antifoam A | 8.1 | 3.6 | 6 |

Figure 2A:
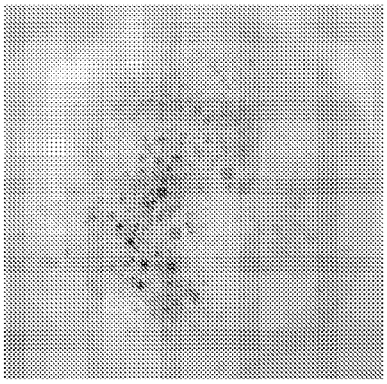
FIGS. 2*a*-2*b* are photographs of Formulation (1A) of Table 1 after a first rinse and after a second rinse, respectively.
Figure 2B:
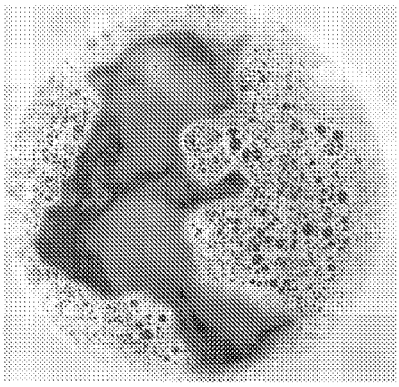
Figure 3A:
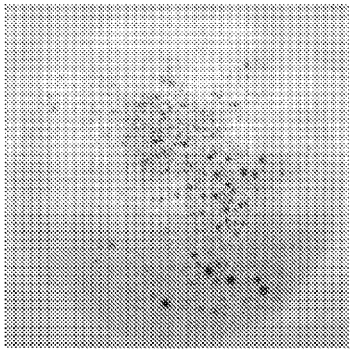
FIGS. 3*a*-3*b* are photographs of Formulation (1B) of Table 1 after a first rinse and after a second rinse, respectively.
Figure 3B:
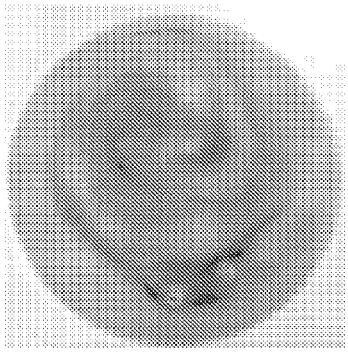
Figure 4A:
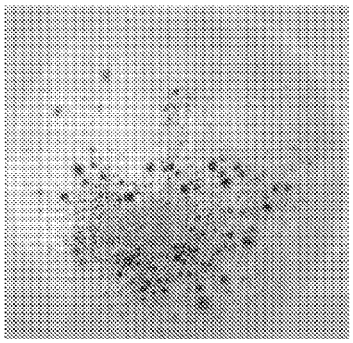
FIGS. 4*a*-4*b* are photographs of Formulation (1C) of Table 1 after a first rinse and after a second rinse, respectively.
Figure 4B:
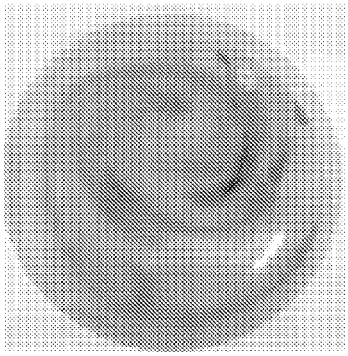
Figure 5A:
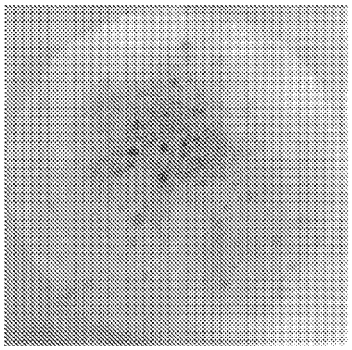
FIGS. 5*a*-5*b* are photographs of Formulation (1D) of Table 1 after a first rinse and after a second rinse, respectively.
Figure 5B:
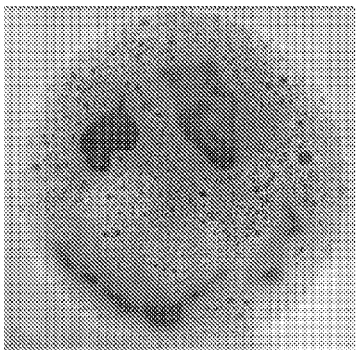
Figure 6A:
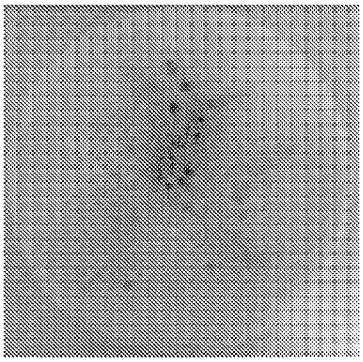
FIGS. 6*a*-6*b* are photographs of Formulation (1E) of Table 1 after a first rinse and after a second rinse, respectively.
Figure 6B:
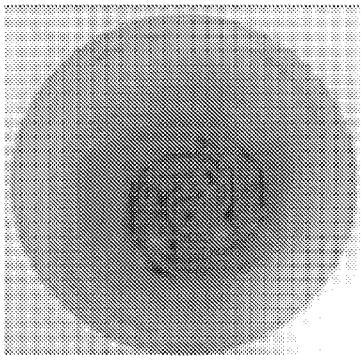
Figure 7A:
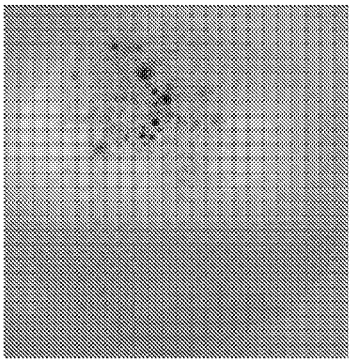
FIGS. 7*a*-7*b* are photographs of Formulation (1F) of Table 1 after a first rinse and after a second rinse, respectively.
Figure 7B:
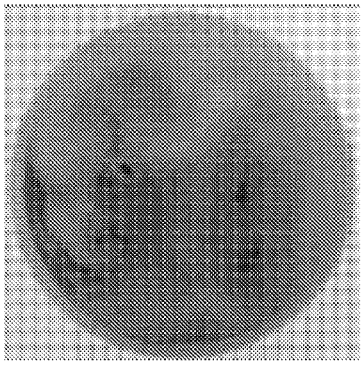
Figure 8A:
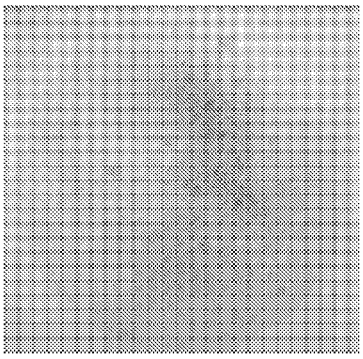
FIGS. 8*a*-8*b* are photographs of Formulation (1G) of Table 1 after a first rinse and after a second rinse, respectively.
Figure 8B:
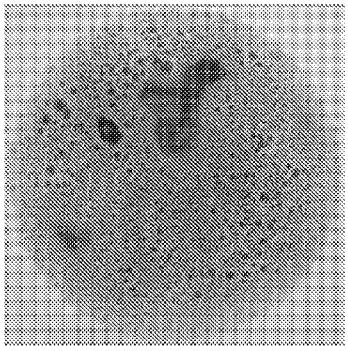
Figure 9A:
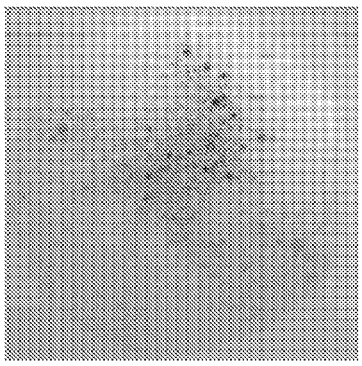
FIGS. 9*a*-9*b* are photographs of Formulation (1H) of Table 1 after a first rinse and after a second rinse, respectively.
Figure 9B:
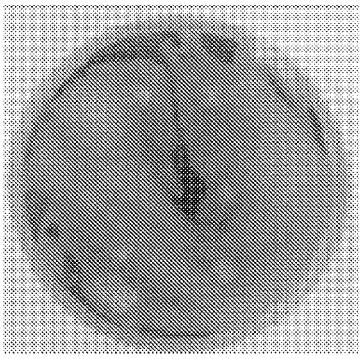

FIGS. 2*a* and 2*b* are photographs of Formulation (1A) of Table 1 above after a first rinse and after a second rinse, respectively. FIGS. 3*a* and 3*b* are photographs of Formulation (1B) of Table 1 above after a first rinse and after a second rinse, respectively. FIGS. 4*a* and 4*b* are photographs of Formulation (1C) of Table 1 above after a first rinse and after a second rinse, respectively. FIGS. 5*a* and 5*b* are photographs of Formulation (1D) of Table 1 above after a first rinse and after a second rinse, respectively. FIGS. 6*a* and 6*b* are photographs of Formulation (1E) of Table 1 above after a first rinse and after a second rinse, respectively. FIGS. 7*a* and 7*b* are photographs of Formulation (1F) of Table 1 above after a first rinse and after a second rinse, respectively. FIGS. 8*a* and 8*b* are photographs of Formulation (1G) of Table 1 above after a first rinse and after a second rinse, respectively. FIGS. 9*a* and 9*b* are photographs of Formulation (1H) of Table 1 above after a first rinse and after a second rinse, respectively.

The addition of the granulated antifoam to each of the detergent powders was shown to have a moderate impact on the foam level after dissolution and after the washing stage. Significant levels of foam were still observed in all examples. The defoaming activity of the detergent powders with the granulated antifoams of the embodiments of the present invention is clearly seen in comparing the foam resulting from the different detergent powders when used alone to the foam levels when the granulated antifoams of the embodiments of the present invention were added to the detergent powders. Specifically, the foam level associated with the detergent powder with the granulated antifoam additions is significantly lower after the first rinse as compared to that associated with the detergent powder alone.

After the second rinse, the surface of the bucket including the detergent powder with the granulated antifoam is no longer covered by foam.

Example 2

The detergent used in this example was SURF EXCEL™. The binding agents included LUTENSOL® AT 80 ($C_{16}$-$C_{18}$ fatty alcohol+80 EO) or CARBOWAX® PEG 8000 (polyethylene glycol) (Dow Chemical Corp., Midland, Mich.).

The granulated antifoam was made as follows. About 91 g of Polysiloxane A was mixed with about 6 g of CAB-O-SIL® TS-530 and about 3 g of AEROSIL® R972 in a dental high shear speed mixer.

In Formulation (2C), about 40 g of the resulting antifoam compound was mixed with about 40 g of LUTENSOL® AT 80 at a temperature of about 80° C. The resulting mixture was then sprayed onto about 200 g of ground sodium sulfate. The spraying was stopped when the powder was agglomerated into granules of about 400-600 μm. The quantity of liquid sprayed was then recorded in order to calculate the level of antifoam in the granule. The granule contained about 9.83% by weight of compound.

In Formulation (2D), about 40 g of the resulting antifoam compound was mixed with about 40 g of CARBOWAX® PEG 8000 at a temperature of about 80° C. The resulting mixture was then sprayed onto about 200 g of ground sodium sulfate. The spraying was stopped when the powder was agglomerated into granules of about 400-600 μm. The quantity of liquid sprayed was then recorded in order to calculate the level of antifoam in the granule. The granule contained about 9.68% by weight of compound.

The testing methods employed were the same as that described with respect to Example 1. The results are provided in Table 2 below and in FIGS. 10*a*-10*d*.

TABLE 2

| Formulation No. | Detergent Powder | Binding Agent in Granulated Antifoam | Foam Height After Dissolution (cm) | Foam Height After Wash (cm) | Rating After Rinse 2 |
|---|---|---|---|---|---|
| (2A) | SURF EXCEL ™ | | 8.6 | 3.4 | 1 |
| (2B) | SURF EXCEL ™ + granulated antifoam | Wax A (from Example 1 above) | 7.3 | 1.7 | 6 |
| (2C) | SURF EXCEL ™ + granulated antifoam | LUTENSOL ® AT 80 | 6.8 | 3.5 | 4 |
| (2D) | SURF EXCEL ™ + granulated antifoam | CARBOWAX ® PEG 8000 | 8.4 | 3.9 | 4 |

Figure 10A:
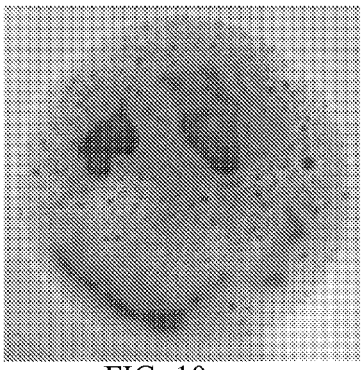
FIGS. 10*a*-*d* are photographs of Formulations (2A)-(2D) of Table 2, respectively, after a second rinse.
Figure 10B:
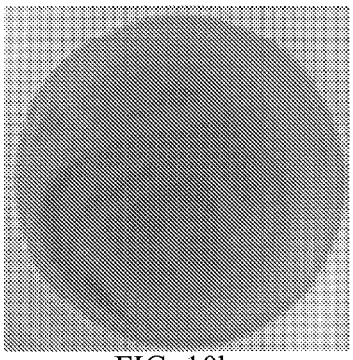
Figure 10C:
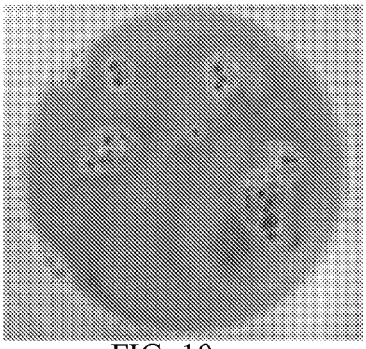
Figure 10D:
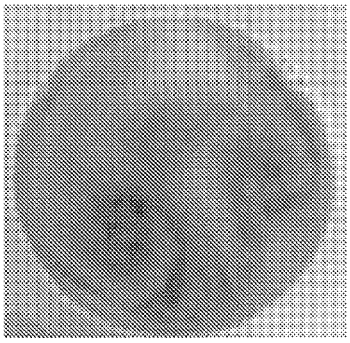

FIG. 10*a* is a photograph of Formulation (2A) of Table 2 above after a second rinse. FIG. 10*b* is a photograph of Formulation (2B) of Table 2 above after a second rinse. FIG. 10*c* is a photograph of Formulation (2C) of Table 2 above after a second rinse. FIG. 10*d* is a photograph of Formulation (2D) of Table 2 above after a second rinse.

None of the formulations had a significant impact on the foaming behavior of the SURF EXCEL™ detergent after its dissolution or after the washing stage. In fact, the different organic binding agents evaluated showed less impact than Wax A. The lower defoaming activity of the evaluated binding agents in the washing stage also translated into lower performance in the rinses, as a thin layer of foam was still visible at the surface of the water in the bucket after the second rinse (see FIGS. 10*a*-10*d*).

Example 3

In this example, the antifoam of the embodiments of the present invention was entrapped with different waxes chosen amongst paraffins, glycerides, quaternary ammoniums, polyethylene glycol, and ethoxylated alcohol. The resulting mixtures were sprayed onto ground sodium sulfate. The obtained granulated antifoams were evaluated during hand washing using the same testing protocol as described above in Example 1.

The detergent used in this example was SURF EXCEL™. The binding agents included LUTENSOL® AT 80, CARBOWAX® PEG 8000, RADIA™ 7512 (glycerol tristearate) (Oleon, Ertvelde, Belgium), RADIA™ 7173 (Oleon, Ertvelde, Belgium), INCROQUAT™ Behenyl TMS (behentrimonium methosulfate and cetyl alcohol and butylene glycol) (Croda, Inc., Edison, N.J.), Verol N-vegetable (glyceryl monostearate), paraffin, and Crodacol S95 EP (stearyl alcohol) (Croda, Inc., Edison, N.J.).

The granulated antifoam of this example was made as follows. About 45.5 g of Polysiloxane A was mixed with about 45.5 g of polyisobutylene (INDOPOL® H25) then with about 6 g of CAB-O-SIL®TS-530 and about 3 g of AEROSIL® R-972 in a dental high shear speed mixer.

In Formulation (3A), about 40 g of the resulting antifoam compound was mixed with about 40 g of Wax A at a temperature of about 60° C. The resulting mixture was then sprayed onto about 200 g of ground sodium sulfate. The spraying was stopped when the powder was agglomerated into granules of about 400-600 μm. The granule contained about 11.15% by weight of compound.

In Formulation (3B), about 40 g of the resulting antifoam compound was mixed with about 40 g of RADIA™ 7512 at a temperature of about 60° C. The resulting mixture was then sprayed onto about 200 g of ground sodium sulfate. The spraying was stopped when the powder was agglomerated into granules of about 400-600 μm. The granule contained about 11.15% by weight of compound.

In Formulation (3C), about 40 g of the resulting antifoam compound was mixed with about 40 g of LUTENSOL® AT 80 at a temperature of about 80° C. The resulting mixture was then sprayed onto about 200 g of ground sodium sulfate. The spraying was stopped when the powder was agglomerated into granules of about 400-600 μm. The granule contained about 8.85% by weight of compound.

In Formulation (3D), about 40 g of the resulting antifoam compound was mixed with about 40 g of RADIA™ 7173 at a temperature of about 60° C. The resulting mixture was then sprayed onto about 200 g of ground sodium sulfate. The spraying was stopped when the powder was agglomerated into granules of about 400-600 μm. The granule contained about 10.91% by weight of compound.

In Formulation (3E), about 40 g of the resulting antifoam compound was mixed with about 40 g of INCROQUAT™ Behenyl TMS at a temperature of about 80° C. The resulting mixture was then sprayed onto about 200 g of ground sodium sulfate. The spraying was stopped when the powder was agglomerated into granules of about 400-600 μm. The granule contained about 9.68% by weight of compound.

In Formulation (3F), about 40 g of the resulting antifoam compound was mixed with about 40 g of paraffin at a temperature of about 50° C. The resulting mixture was then sprayed onto about 200 g of ground sodium sulfate. The spraying was stopped when the powder was agglomerated into granules of about 400-600 μm. The granule contained about 11.40% by weight of compound.

In Formulation (3G), about 40 g of the resulting antifoam compound was mixed with about 40 g of Crodacol S65 EP at a temperature of about 60° C. The resulting mixture was then sprayed onto about 200 g of ground sodium sulfate. The spraying was stopped when the powder was agglomerated into granules of about 400-600 μm. The granule contained about 15.95% by weight of compound.

The testing methods employed were the same as that described with respect to Example 1. The results are provided in Table 3 below and in FIGS. 11*a-g*.

TABLE 3

| Formulation No. | Detergent Powder | Binding Agent in Granulated Antifoam | Foam Height After Dissolution (cm) | Foam Height After Wash (cm) | Rating After Rinse 2 |
|---|---|---|---|---|---|
| (3A) | SURF EXCEL ™ + granulated antifoam | Wax A | 7.1 | 2.7 | 6 |
| (3B) | SURF EXCEL ™ + granulated antifoam | RADIA ™ 7512 | 8.4 | 3.5 | 2 |
| (3C) | SURF EXCEL ™ + granulated antifoam | LUTENSOL ® AT 80 | 7.3 | 3.8 | 4 |
| (3D) | SURF EXCEL ™ + granulated antifoam | RADIA ™ 7173 | 8.3 | 3.6 | 2 |
| (3E) | SURF EXCEL ™ + granulated antifoam | INCROQUAT ™ | 7.8 | 3.5 | 3 |
| (3F) | SURF EXCEL ™ + granulated antifoam | Paraffin | 8.2 | 4.9 | 3 |
| (3G) | SURF EXCEL ™ + granulated antifoam | Crodacol S95EP | 8.3 | 4.8 | 4 |

Figure 11A:
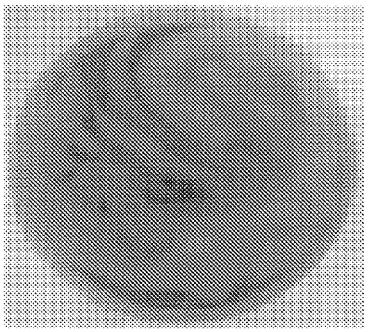
FIGS. 11*a*-*g* are photographs of Formulations (3A)-(3G) of Table 3, respectively, after a second rinse.
Figure 11B:
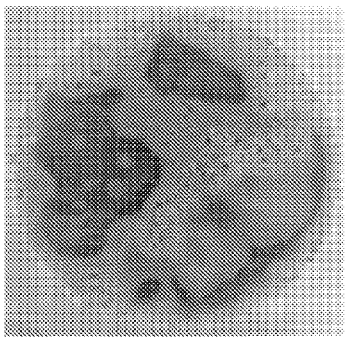
Figure 11C:
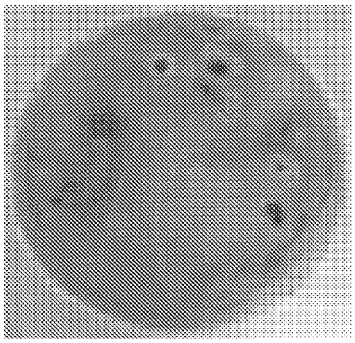
Figure 11D:
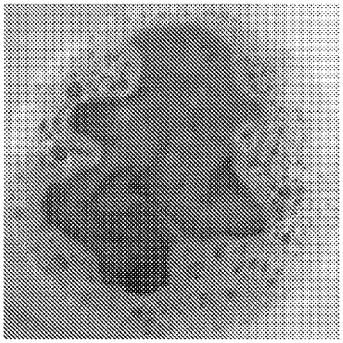
Figure 11E:
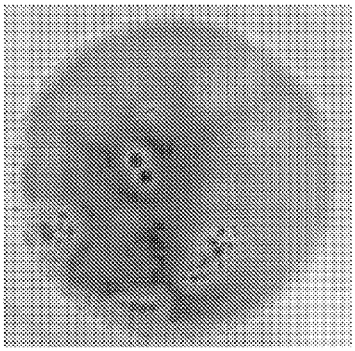
Figure 11F:
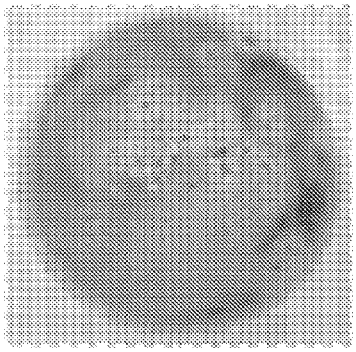
Figure 11G:
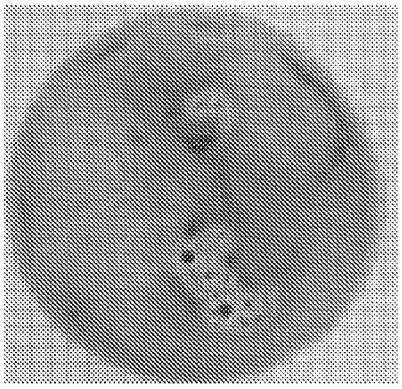

FIG. 11*a* is a photograph of Formulation (3A) of Table 3 above after a second rinse. FIG. 11*b* is a photograph of Formulation (3B) of Table 3 above after a second rinse. FIG. 11*c* is a photograph of Formulation (3C) of Table 3 above after a second rinse. FIG. 11 *d* is a photograph of Formulation (3D) of Table 3 above after a second rinse. FIG. 11*e* is a photograph of Formulation (3E) of Table 3 above after a second rinse. FIG. 11*f* is a photograph of Formulation (3F) of Table 3 above after a second rinse. FIG. 11*g* is a photograph of Formulation (3G) of Table 3 above after a second rinse.

None of the different formulations had a significant impact on the foaming behavior of the SURF EXCEL™ detergent after its dissolution or after the washing stage. The different waxes evaluated even showed less impact than Wax A. The lower defoaming activity of the evaluated waxes in the washing stage also translated into lower performance in the rinses. Namely, foam layers of varying thicknesses and persistency were observed in the second rinse, all demonstrating a lower defoaming effect than the formulation containing Wax A.

Example 4

In this example, the antifoam was entrapped with a mixture of Wax A and glyceryl monostearate (GMS). The obtained granulated antifoams were evaluated during hand washing using the same testing protocol as described in Example 1 above.

The detergent used in this example was SURF EXCEL™. The binding agent was Verol N-vegetable (glyceryl monostearate, Keyser McKay, Amsterdam, the Netherlands).

The granulated antifoam of this example was made as follows. About 45.5 g of Polysiloxane A was mixed with about 45.5 g of polyisobutylene (INDOPOL® H25), which was then mixed with about 6 g of CAB-O-SIL® TS-530 and about 3 g of AEROSIL® R-972 in a dental high shear speed mixer.

In Formulation (4A), about 40 g of the resulting antifoam compound was mixed with about 40 g of Wax A at a temperature of about 60° C. The resulting mixture was then sprayed onto about 200 g of ground sodium sulfate. The spraying was stopped when the powder was agglomerated into granules of about 400-600 μm. The granule contained about 11.15% by weight of compound.

In Formulation (4B), about 40 g of the resulting antifoam compound was mixed with about 30 g of Wax A and about 10 g of Verol N at a temperature of about 60° C. The resulting mixture was then sprayed onto about 200 g of ground sodium sulfate. The spraying was stopped when the powder was agglomerated into granules of about 400-600 μm. The granule contained about 8.98% by weight of compound.

In Formulation (4C), about 40 g of the resulting antifoam compound was mixed with about 20 g of Wax A and about 20 g of Verol N at a temperature of about 60° C. The resulting mixture was then sprayed onto about 200 g of ground sodium sulfate. The spraying was stopped when the powder was agglomerated into granules of about 400-600 μm. The granule contained about 11.77% by weight of compound.

In Formulation (4D), about 40 g of the resulting antifoam compound was mixed with about 10 g of Wax A and about 30 g of Verol N at a temperature of about 60° C. The resulting mixture was then sprayed onto about 200 g of ground sodium sulfate. The spraying was stopped when the powder was agglomerated into granules of about 400-600 μm. The granule contained about 12.98% by weight of compound.

In Formulation (4E), about 40 g of the resulting antifoam compound was mixed with about 40 g of Verol N at a temperature of about 60° C. The resulting mixture was then sprayed onto about 200 g of ground sodium sulfate. The spraying was stopped when the powder was agglomerated into granules of about 400-600 μm. The granule contained about 14.8% by weight of compound.

The testing methods employed were the same as that described with respect to Example 1. The results are provided in Table 4 below and in FIGS. 12*a*-12*e*.

TABLE 4

| Formulation No. | Detergent Powder | Binding Agent in Granulated Antifoam | Foam Height After Dissolution (cm) | Foam Height After Wash (cm) | Rating After Rinse 2 |
|---|---|---|---|---|---|
| (4A) | SURF EXCEL ™ + granulated antifoam | 40 g Wax A | 7.1 | 2.7 | 6 |
| (4B) | SURF EXCEL ™ + granulated antifoam | 30 g Wax A + 10 g Verol N | 6.5 | 2.1 | 5-6 |
| (4C) | SURF EXCEL ™ + granulated antifoam | 20 g Wax A + 20 g Verol N | 8.8 | 3.8 | 5 |
| (4D) | SURF EXCEL ™ + granulated antifoam | 10 g Wax A + 30 g Verol N | 8.0 | 4.2 | 3-4 |
| (4E) | SURF EXCEL ™ + granulated antifoam | 40 g Verol N | 9.0 | 5.1 | 2 |

Figure 12A:
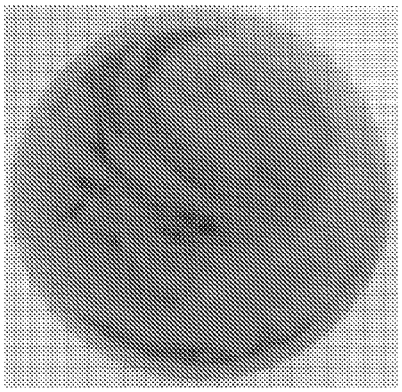
FIGS. 12*a*-*e* are photographs of Formulations (4A)-(4E) of Table 4, respectively, after a second rinse.
Figure 12B:
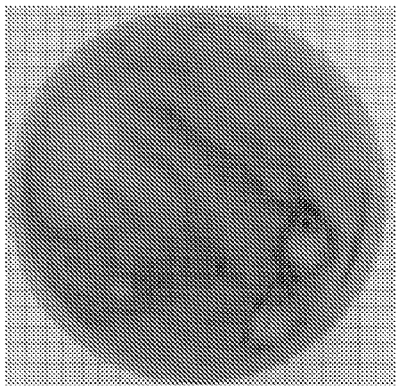
Figure 12C:
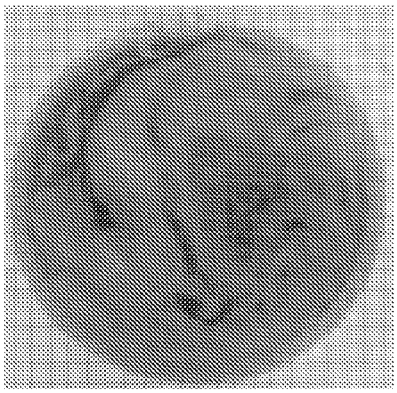
Figure 12D:
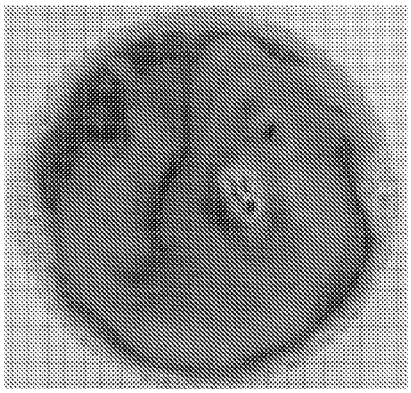
Figure 12E:
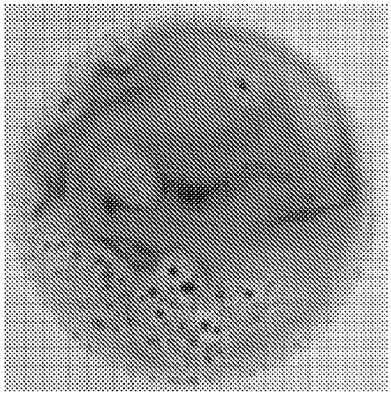

FIG. 12*a* is a photograph of Formulation (4A) of Table 4 above after a second rinse. FIG. 12*b* is a photograph of Formulation (4B) of Table 4 above after a second rinse. FIG. 12*c* is a photograph of Formulation (4C) of Table 4 above after a second rinse. FIG. 12*d* is a photograph of Formulation (4D) of Table 4 above after a second rinse. FIG. 12*e* is a photograph of Formulation (4E) of Table 4 above after a second rinse.

None of the different formulations had a significant impact on the foaming behavior of the SURF EXCEL™ detergent after its dissolution or after the washing stage. Replacing Wax A with Verol N in the granule formulation led to an increase of foam on the surface of the bucket after the second rinse. The increase in foam continued to increase as a greater amount of Verol N was substituted for Wax A.

Example 5

In this example, the antifoam of the embodiments of the present invention was entrapped with a mixture of Wax A and either LUTENSOL® AT 80 or CARBOWAX® PEG 8000. The resulting granulated antifoams were evaluated during hand washing using the same testing protocol as described above in Example 1.

The detergent used in this example was SURF EXCEL™. The binding agents included LUTENSOL® AT 80 or CARBOWAX® PEG 8000.

The granulated antifoam of this example was made as follows. About 45.5 g of Polysiloxane A was mixed with about 45.5 g of polyisobutylene (INDOPOL® H25), which was then mixed with about 6 g of CAB-O-SIL® TS-530 and about 3 g of AEROSIL® R-972 in a dental high shear speed mixer.

In Formulation (5A), about 40 g of the resulting antifoam compound was mixed with about 40 g of Wax A at a temperature of about 60° C. The resulting mixture was then sprayed onto about 200 g of ground sodium sulfate. The spraying was stopped when the powder was agglomerated into granules of about 400-600 μm. The granule contained about 11.15% by weight of compound.

In Formulation (5B), about 40 g of the resulting antifoam compound was mixed with about 20 g of Wax A and about 20 g of LUTENSOL® AT 80 at a temperature of about 80° C. The resulting mixture was then sprayed onto about 200 g of ground sodium sulfate. The spraying was stopped when the powder was agglomerated into granules of about 400-600 μm. The granule contained about 10.77% by weight of compound.

In Formulation (5C), about 40 g of the resulting antifoam compound was mixed with about 20 g of Wax A and about 20 g of CARBOWAX® PEG 8000 at a temperature of about 80° C. The resulting mixture was then sprayed onto about 200 g of ground sodium sulfate. The spraying was stopped when the powder was agglomerated into granules of about 400-600 μm. The granule contained about 10.86% by weight of compound.

The testing methods employed were the same as that described with respect to Example 1. The results are provided in Table 5 below and in FIGS. 13*a*-13*c*.

TABLE 5

| Formulation No. | Detergent Powder | Binding Agent in Granulated Antifoam | Foam Height After Dissolution (cm) | Foam Height After Wash (cm) | Rating After Rinse 2 |
|---|---|---|---|---|---|
| (5A) | SURF EXCEL ™ + granulated antifoam | Wax A | 7.1 | 2.7 | 6 |
| (5B) | SURF EXCEL ™ + granulated antifoam | Wax A + LUTENSOL ® AT80 | 7.2 | 3.6 | 6 |

TABLE 5-continued

| Formulation No. | Detergent Powder | Binding Agent in Granulated Antifoam | Foam Height After Dissolution (cm) | Foam Height After Wash (cm) | Rating After Rinse 2 |
|---|---|---|---|---|---|
| (5C) | SURF EXCEL ™ + granulated antifoam | Wax A + CARBOWAX ® PEG 8000 | 7.7 | 3.5 | 4 |

Figure 13A:
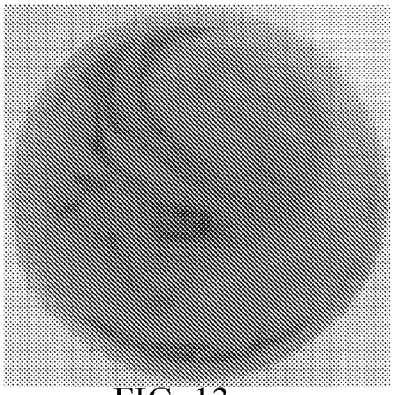
FIGS. 13*a*-*c* are photographs of Formulations (5A)-(5C) of Table 5, respectively, after a second rinse.
Figure 13B:
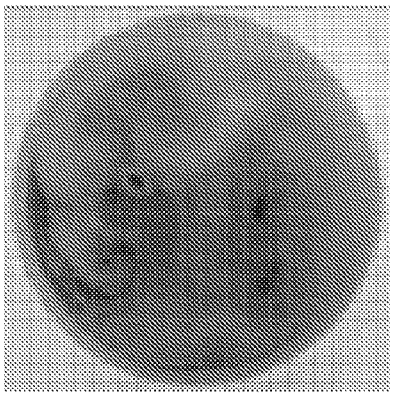
Figure 13C:
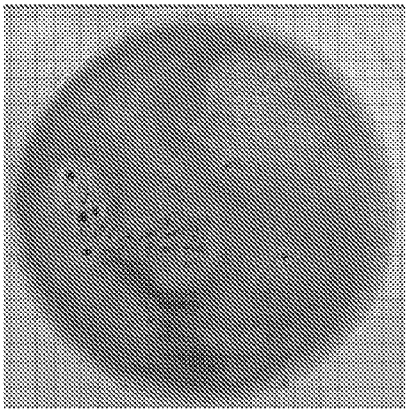

FIG. 13*a* is a photograph of Formulation (5A) of Table 5 above after a second rinse. FIG. 13*b* is a photograph of Formulation (5B) of Table 5 above after a second rinse. FIG. 13*c* is a photograph of Formulation (5C) of Table 5 above after a second rinse.

None of the different formulations had a significant impact on the foaming behavior of the SURF EXCEL™ detergent after its dissolution or after the washing stage. While mixing Wax A with CARBOWAX® PEG 8000 led to a loss of performance in the rinse, the Wax A+LUTENSOL® AT80 mixture resulted in very good defoaming in the rinse.

Example 6

In this example, the antifoam of the embodiments of the present invention was entrapped with a trimethylstearyloxysilane and stearyl alcohol (hereinafter "Wax B"). The obtained granulated antifoams were evaluated during hand washing using the same testing protocol as described above in Example 1.

The detergent used in this example was SURF EXCEL™. The binding agent used was Wax B.

The granulated antifoam of this example was made as follows. About 45.5 g of Polysiloxane A was mixed with about 45.5 g of polyisobutylene (INDOPOL® H25), which was then mixed with about 6 g of CAB-O-SIL® TS-530 and about 3 g of AEROSIL® R-972 in a dental high shear speed mixer.

In Formulation (6A), about 40 g of the resulting antifoam compound was mixed with about 40 g of Wax A at a temperature of about 60° C. The resulting mixture was then sprayed onto about 200 g of ground sodium sulfate. The spraying was stopped when the powder was agglomerated into granules of about 400-600 μm. The granule contained about 11.15% by weight of compound.

In Formulation (6B), about 40 g of the resulting antifoam compound was mixed with about 40 g of Wax B at a temperature of about 80° C. The resulting mixture was then sprayed onto about 200 g of ground sodium sulfate. The spraying was stopped when the powder was agglomerated into granules of about 400-600 μm. The granule contained about 10.06% by weight of compound.

The testing methods employed were the same as that described with respect to Example 1. The results are provided in Table 6 below and in FIGS. 14*a*-14*b*.

TABLE 6

| Formulation No. | Detergent Powder | Binding Agent in Granulated Antifoam | Foam Height After Dissolution (cm) | Foam Height After Wash (cm) | Rating for Rinse 2 |
|---|---|---|---|---|---|
| (6A) | SURF EXCEL ™ + granulated antifoam | 40 g Wax A | 7.1 | 2.7 | 6 |
| (6B) | SURF EXCEL ™ + granulated antifoam | 40 g Wax B | 7.4 | 2 | 5-6 |

Figure 14A:
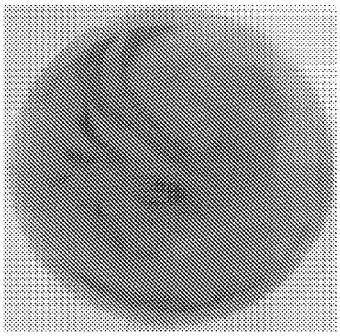
FIGS. 14*a*-*b* are photographs of Formulations (6A)-(6B) of Table 6, respectively, after a second rinse.
Figure 14B:
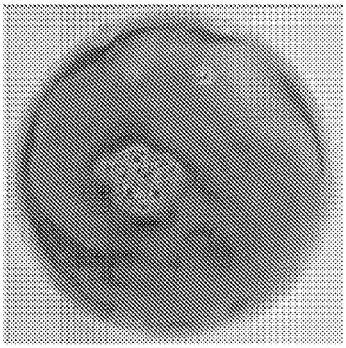

FIG. 14*a* is a photograph of Formulation (6A) of Table 6 above after a second rinse. FIG. 14*b* is a photograph of Formulation (6B) of Table 6 above after a second rinse.

Wax B had slightly more impact than Wax A on the wash lather, but good defoaming performance was obtained in the second rinse for both Formulations (6A) and (6B).

While the invention is susceptible to various modifications and alternative forms, specific embodiments have been shown by way of example in the examples and described in detail herein. It should be understood, however, that the invention is not intended to be limited to the particular forms disclosed. Rather, the invention is to cover all modifications, equivalents, and alternatives falling within the spirit and scope of the invention as defined by the appended claims.

The invention claimed is:

1. A granulated antifoam composition comprising:

(1) an antifoam component including;

(a) a hydrophobic fluid having a surface tension of at least 27 mN/m and less than 40 mN/m, and (b) a finely divided solid hydrophobic filler dispersed in the hydrophobic fluid (a);

(2) a silicon-containing wax binder that is solid at room temperature and having at least one alkyl group; and (3) a carrier different from the hydrophobic filler (b).

2. The granulated antifoam composition of claim 1, wherein the hydrophobic fluid (a) is selected from polyisobutylene, an organopolysiloxane fluid, or a combination thereof.

3. The granulated antifoam composition of claim 1, wherein the at least one alkyl group of the silicon-containing wax binder (2) comprises a C12 to C80 alkyl group.

4. The granulated antifoam composition of claim 1, further comprising: (4) at least one organic binder different from the silicon-containing wax binder (2).

5. A detergent composition comprising:

a surfactant; and the granulated antifoam composition of claim 1.

6. The detergent composition according to claim 5, which is selected from a laundry detergent, a detergent for dish washing, or a detergent for personal care, alternatively which is a detergent for personal care and is selected from a shampoo, a shower gel, or a soap bar.

7. The granulated antifoam composition of claim 1, wherein the silicon-containing wax binder (2) has a melting point of from about 30° C. to about 100° C.

8. A method of forming a granulated antifoam formulation, the method comprising:

i) combining (a) a hydrophobic fluid and (b) a hydrophobic filler to form (1) an antifoam component, wherein the hydrophobic fluid (a) has a surface tension of at least 27 mN/m and less than 40 mN/m; and ii) depositing the antifoam component (1) and (2) a silicon-containing wax binder onto (3) a carrier to granulate the antifoam component (1), wherein the silicon-containing wax binder (2) is solid at room temperature and comprises at least one alkyl group and wherein the carrier (3) is different from the hydrophobic filler (b).

9. The method of claim 8, wherein in step ii) the antifoam component (1) and the silicon-containing wax binder (2) are sprayed onto the carrier (3).

10. The method of claim 8, wherein the hydrophobic fluid (a) is selected from polyisobutylene, an organopolysiloxane fluid, or a combination thereof.

11. The method of claim 8, wherein the at least one alkyl group of the silicon-containing wax binder (2) comprises a C12 to C80 alkyl group.

12. The method of claim 8, wherein-step ii) is further defined as: depositing the antifoam component (1), (2) a silicon-containing wax binder, and (4) an organic binder different from the silicon-containing wax binder (2) onto (3) a carrier to granulate the antifoam component (1).

13. The method of claim 8, wherein step ii) is performed at a temperature at which the silicon-containing wax binder (2) is in liquid form.

14. The method of claim 8, wherein in step ii) the antifoam component (1) and the silicon-containing wax binder (2) are separately deposited onto the carrier (3) to granulate the antifoam component (1).

15. A method of washing a substrate, the method comprising:

i) applying a detergent composition to the substrate, the detergent composition including a surfactant and a granulated antifoam composition, the granulated antifoam composition comprising:

(1) an antifoam component including;

(a) a hydrophobic fluid having a surface tension of at least 27 mN/m and less than 40 mN/m, and (b) a finely divided solid hydrophobic filler dispersed in the hydrophobic fluid (a);

(2) a silicon-containing wax binder that is solid at room temperature and having at least one alkyl group; and (3) a carrier different from the hydrophobic filler (b);

ii) washing the substrate in an aqueous medium with the detergent composition, whereby the antifoam composition does not substantially affect foaming during the washing step ii); and iii) rinsing the substrate having the applied detergent composition with water, whereby foaming during the rinsing step iii) is inhibited.

16. The method of claim 15, wherein the hydrophobic fluid (a) is selected from polyisobutylene, an organopolysiloxane fluid, or a combination thereof.

17. The method of claim 15, wherein the at least one alkyl group of the silicon-containing wax binder (2) comprises a C12 to C80 alkyl group.

18. The granulated antifoam composition of claim 1, wherein the antifoam component (1) and the silicon-containing wax binder (2) are disposed on the carrier (3).

19. The granulated antifoam composition of claim 1, wherein:

I) the silicon-containing wax binder (2) comprises;

i) a dimethyl, methyloctadecylsiloxane, trimethylterminated polysiloxane, or ii) a trimethylstearyloxysilane;

II) the carrier (3) comprises a sulfate, alternatively comprises sodium sulfate; or III) both I) and II).

20. The granulated antifoam composition of claim 19, wherein:

I) the hydrophobic liquid (a) comprises a polysiloxane, alternatively comprises a substantially linear polysiloxane having a viscosity of about 1200 cSt;

II) the hydrophilic filler (b) comprises silica, alternatively comprises fumed silica; or III) both I) and II).

* * * * *